US012753688B2

(12) United States Patent
Kane et al.

(10) Patent No.: US 12,753,688 B2
(45) Date of Patent: Oct. 6, 2026

(54) INTEGRATING ETHERNET TECHNOLOGY WITHIN DRILLING SYSTEMS

(71) Applicant: Schlumberger Technology Corporation, Sugar Land, TX (US)

(72) Inventors: Alha Kane, Richmond, TX (US); Antoine Benard, Houston, TX (US); Nicholas Smith, Katy, TX (US); Ken-Vidar Ditlefsen, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 155 days.

(21) Appl. No.: 18/664,612

(22) Filed: May 15, 2024

(65) Prior Publication Data

US 2025/0354475 A1 Nov. 20, 2025

(51) Int. Cl.
*E21B 44/00* (2006.01)
*E21B 47/13* (2012.01)

(52) U.S. Cl.
CPC ..... *E21B 44/005* (2013.01); *E21B 47/13* (2020.05); *E21B 2200/22* (2020.05)

(58) Field of Classification Search
CPC ..... E21B 47/12; E21B 44/005; E21B 47/13; E21B 2200/22
See application file for complete search history.

(56) References Cited

U.S. PATENT DOCUMENTS

| | | | | |
|---|---|---|---|---|
| 9,683,438 | B2 | 6/2017 | Fanini et al. | |
| 10,711,601 | B2 | 7/2020 | Sarac et al. | |
| 11,473,418 | B1 * | 10/2022 | Kelpe | E21B 7/28 |
| 11,815,650 | B2 | 11/2023 | Tawil et al. | |
| 2004/0039466 | A1 * | 2/2004 | Lilly | H04L 12/40032 700/95 |
| 2005/0194182 | A1 * | 9/2005 | Rodney | E21B 47/12 175/24 |
| 2010/0050017 | A1 * | 2/2010 | Almadi | E21B 47/12 713/400 |
| 2016/0084076 | A1 * | 3/2016 | Fanini | H04L 67/12 340/853.1 |
| 2017/0107074 | A1 * | 4/2017 | Georget | B65H 63/00 |
| 2020/0088026 | A1 * | 3/2020 | Buternowsky | H04L 27/206 |
| 2020/0270978 | A1 * | 8/2020 | Dobkins | E21B 44/02 |
| 2021/0332697 | A1 * | 10/2021 | Pihl | H04B 5/79 |
| 2025/0354475 | A1 * | 11/2025 | Kane | E21B 44/005 |

* cited by examiner

*Primary Examiner* — Daniel P Stephenson
(74) *Attorney, Agent, or Firm* — Jeffrey D. Frantz

(57) ABSTRACT

A system includes a first tool including first control circuitry, wherein the first tool is configured to perform a first operation within a borehole, and a second tool including second control circuitry, wherein the second tool is configured to perform a second operation within the borehole, and wherein the first control circuitry is configured to communicate with the second control circuitry via Ethernet.

20 Claims, 4 Drawing Sheets

INTEGRATING ETHERNET TECHNOLOGY WITHIN DRILLING SYSTEMS

BACKGROUND

The present disclosure generally relates to systems and methods for employing networking technology in hydrocarbon exploration tools. More specifically, the present disclosure is related to improving networking technology in downhole tools to facilitate management and consumption of data.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it may be understood that these statements are to be read in this light, and not as admissions of prior art.

Generally, downhole tools obtain (e.g., generate, acquire) and/or store data associated with formation, wellbore properties, equipment health, and/or any other suitable data associated with subsurface conditions or the downhole tools themselves. The downhole tools may include a central memory to store the data associated with the formation, the wellbore properties, and/or the equipment health. However, it may be difficult to manage and/or store a large amount of data obtained by the downhole tools in the central memory. Further, accessing the data may involve employing custom auxiliary equipment and/or applications, which may be complex and inefficient. Thus, it may be desired to improve data storage and/or accessibility of the data for downhole tools.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a system includes a first tool including first control circuitry, wherein the first tool is configured to perform a first operation within a borehole, and a second tool including second control circuitry, wherein the second tool is configured to perform a second operation within the borehole, and wherein the first control circuitry is configured to communicate with the second control circuitry via Ethernet.

In an embodiment, a tangible, non-transitory, computer-readable medium includes instructions that, when executed by processing circuitry, are configured to cause the processing circuitry to instruct a first tool to perform a first operation within a borehole, retrieve a set of data for transmission to additional processing circuitry of a second tool configured to perform a second operation within the borehole, wherein the set of data for transmission is identified based on the first operation, and transmit the set of data to the additional processing circuitry via Ethernet.

In an embodiment, a method includes instructing, via first control circuitry, a first tool of a drilling system to perform a first operation within a borehole, retrieving, via the first control circuitry, a set of data for transmission to second control circuitry of the drilling system, a data acquisition system, or both, based on the first operation, and transmitting, via the first control circuitry, the set of data to the second control circuitry via Ethernet.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
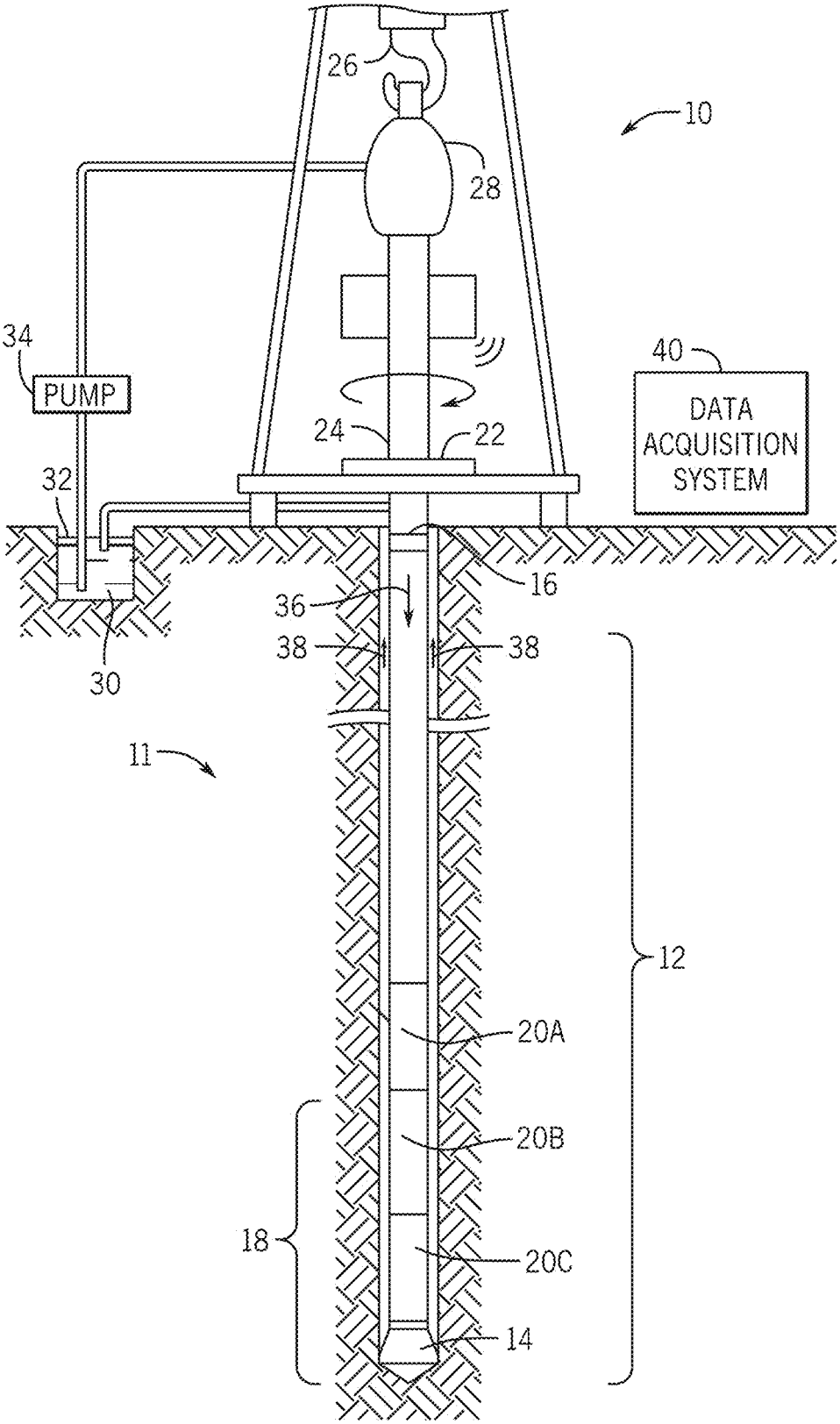
FIG. 1 is a schematic diagram of a drilling system, in accordance with an embodiment of the present disclosure.

Certain embodiments commensurate in scope with the present disclosure are summarized below. These embodiments are not intended to limit the scope of the disclosure, but rather these embodiments are intended only to provide a brief summary of certain disclosed embodiments. Indeed, the present disclosure may encompass a variety of forms that may be similar to or different from the embodiments set forth below.

As used herein, the term "coupled" or "coupled to" may indicate establishing either a direct or indirect connection (e.g., where the connection may not include or include intermediate or intervening components between those coupled), and is not limited to either unless expressly referenced as such. The term "set" may refer to one or more items. Wherever possible, like or identical reference numerals are used in the figures to identify common or the same elements. The figures are not necessarily to scale and certain features and certain views of the figures may be shown exaggerated in scale for purposes of clarification.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Furthermore, when introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment," "an embodiment," or "some embodiments" of the present disclosure are not intended to be interpreted as excluding the existence of additional embodiments that also incorporate the recited features. Furthermore, the phrase A "based on" B is intended to mean that A is at least partially based on B. Moreover, unless expressly stated otherwise, the term "or" is intended to be inclusive (e.g., logical OR) and not exclusive (e.g., logical XOR). In other words, the phrase A "or" B is intended to mean A, B, or both A and B.

Downhole tools may obtain (e.g., generate, acquire) and/or store data associated with formation, wellbore properties, equipment health, and/or any other suitable data associated with subsurface conditions or the downhole tools. The downhole tools may store the data in a single central memory or in multiple memory storage locations. However, an amount of the data that may be stored in the single central memory may be limited. In addition, the amount of processing power available within each downhole tool may be limited. As such, analysis performed by the downhole tools based on the data may also be limited. Therefore, it may be desired to improve communication and networking between downhole tools while the tools are positioned downhole within a borehole to improve the manner in which data is stored and/or processed by the downhole tools for real-time functions and/or post run analysis. Moreover, accessing the stored data may involve employing custom auxiliary equipment and/or applications, which may be complex. Thus, it may be desired to improve accessibility and/or efficiency in retrieval of the data stored by the downhole tools after the downhole tools are extracted from the borehole.

The present embodiments described herein include a drilling system, which includes one or more downhole tools that employ Ethernet networking (e.g., Ethernet communication protocols) via tool control circuitry to enable Ethernet communication while the downhole tools are in operation and positioned within the borehole. The Ethernet networking may include hardware technology (e.g., Power over Ethernet (POE) switch, physical layer devices (PHYs), switches, and the like) and/or software technology (e.g., communication stacks, network drivers, protocol analyzers, and the like). For example, each respective downhole tool of the downhole tools may include the tool control circuitry, which may be integrated with the Ethernet networking hardware. Further, each respective downhole tool may include one or more sensors that may be communicatively coupled to the tool control circuitry.

The tool control circuitry may obtain data via the sensors, other downhole tools, and/or the data acquisition system. The tool control circuitry may also store data associated with the respective downhole tool and/or with the other downhole tools. Further, each of the tool control circuitry may include a communication component that includes the Ethernet networking hardware or components. As such, the communication component may enable communication (e.g., transmission, reception) of data between each of the downhole tools and within each of the downhole tools (e.g., facilitating communication to different computing components within the same tool) while the downhole tools are within the borehole or positioned in the subsurface area. Further, after performing its operations and being extracted from the subsurface area, the communication component may be accessible via a port or other hardware adaptor to facilitate Ethernet networking with a data acquisition system (e.g., a surface system) positioned at the surface. For example, the downhole tools may communicate with one another via the POE switch. As another example, the downhole tools may communicate with the data acquisition system when the downhole tools are present at a surface (e.g., not downhole) via an Ethernet network communication port or the like. Accordingly, the tool control circuitry may facilitate management, storage (e.g., redundant storage), and/or consumption of data collected by each of the downhole tools of the drilling system. Indeed, the tool control circuitry may enable redundancy for storing records and efficiency in data storage by enabling a transfer of data between each of the downhole tools and/or the data acquisition system simultaneously or at separate times (e.g., via the PoE switch). Additionally or alternatively, each of the downhole tools may be communicatively coupled (e.g., networked) to a switch (e.g., external switch, central hub). Thus, at least some or all of the downhole tools may receive a copy of the data passing through the switch. Therefore, the data may be analyzed and/or stored in parallel, which may improve network monitoring capabilities and efficiency.

In some embodiments, the downhole tools may each employ machine learning (ML) algorithms and/or models to improve operations of the tool control circuitry and other data operations performed by the downhole tools. For example, ML algorithms may be employed to interpret measurements acquired from one or more separate downhole tools, infer features or conditions to enable a respective downhole tool to autonomously adjust operations, communicate and/or store data in a more compact or useful format (e.g., as opposed to raw data), and the like. By way of example, the nature of the decisions made by each of the downhole tools itself based on the data communicated to the respective tool in real time via the Ethernet networking described herein may include adjusting drilling (and/or logging) operation, adjusting steering commands to a rotary steerable system (RSS) to remain within reservoir boundaries, adapting drilling parameters (e.g., weight on bit, mud flow, drill string rotation) to mitigate destructive drilling dysfunctions (e.g., stick-slip, whirl, bit bounce, etc.), adapting firing/acquisition sequence of a subsystem to collect better measurements, and the like. With this in mind, the downhole tool may receive data from other tool control circuitry of different downhole tools. The receiving downhole tool may use respective control circuitry to apply a ML model to the received data (e.g., via the Ethernet network while downhole) and/or any other suitable data acquired by the respective drilling system to determine improved operations for the respective downhole tool. As an example, the ML model may be applied to the received data to better assess the type of formation that the downhole tools may be traversing and the ML model (or other analytic tool) may adjust the rate or force applied by a drilling tool based on the analysis performed by another downhole too (e.g., via control circuitry) based on data received by the respective tool from another tool via Ethernet networking during the downhole operations. In some embodiments, the analyzing downhole tool may send (e.g., transmit) a number of commands to at least one of the tool control circuitries for each respective downhole tool (e.g., via Ethernet networking) to cause the respective downhole tool to adjust operations.

With the foregoing in mind, FIG. 1 is a schematic diagram of a drilling system 10, in accordance with an embodiment of the present disclosure. The drilling system 10 may include a downhole system 11. The downhole system 11 may include a drill string 12 and a drill bit assembly 14. The drill string 12 may be suspended within a borehole 16, which is formed within subsurface formations through a process of rotary drilling (e.g., advancing the drill bit assembly 14 into a surface). Moreover, the drill string 12 may include a downhole assembly 18 (e.g., bottom hole assembly), which includes the drill bit assembly 14 at a lower end (e.g., bottom end) of the downhole assembly 18. The downhole assembly 18 may include one or more downhole tools 20 (e.g., a first tool 20A, a second tool 20B, a third tool 20C). It should be noted that while FIG. 1 depicts a vertical well, present embodiments may be employed in any other suitable environment, such as a horizontal well. It should also be noted that while the first tool 20A, the second tool 20B, and the third tool 20C are described herein, the downhole assembly 18 may include any number of suitable downhole tools.

By way of example, the first tool 20A, the second tool 20B, and the third tool 20C may each include respective tool control circuitry. Each of the tool control circuitry may employ Ethernet technology to enable Ethernet communication between the first tool 20A, the second tool 20B, the third tool 20C, and/or the data acquisition system 40. For example, the first tool 20A may initiate a communication process (via respective tool control circuitry) with the second tool 20B by sending a number of data packets to the second tool 20B (which is connected to the same Ethernet network as the first tool 20A) using an Ethernet communication stack. Moreover, the first tool 20A and the second tool 20B may communicate via network layer protocols that provide unique identifiers (e.g., Internet Protocol (IP) addresses) in Ethernet packet headers, such as Internet Protocol version 4 (IPv4), Internet Protocol version 6 (IPv6). As another example, the first tool 20A and the second tool 20B may communicate using Transmission Control Protocol (TCP) to enable the number of data packets to be sent in a particular order (e.g., without loss or duplication). The second tool 20B may then receive the number of data packets (via the respective tool control circuitry). In this manner, the downhole tools 20 may employ the Ethernet networking to communicate directly with one another efficiently while increasing throughput.

In some embodiments, the Ethernet networking may operate based on various standards set by the Institute of Electrical and Electronics Engineers (IEEE). As an example, the Ethernet technology may employ the IEEE 802.3 standard, which defines protocols and/or specifications for physical and/or data link layers of a network to manage how devices share a communication medium (e.g., twisted pair cable, coaxial cable, fiber optic cable). As another example, the Ethernet technology may communicate via a Carrier Sense Multiple Access with Collision Detection (CSMA/CD) MAC protocol, which includes half duplex (e.g., shared medium) operation or full duplex operation. In addition, the Ethernet networking operations performed between the downhole tools 20 may involve using Ethernet technology to create local area networks (LANs) or wide area networks (WANs) between the downhole tools 20 via practices, protocols, and hardware used to establish communication between devices within a network using Ethernet technology.

The first tool 20A, the second tool 20B, and the third tool 20C may include any suitable tool for performing hydrocarbon exploration and production operations. For instance, the tools 20 may include drilling tools that may cut through rock formations, completion tools that may be used to provide structural integrity (e.g., casing, tubing, packers) to a wellbore, intervention tools (e.g., wireline tools, coiled tubing tools) to perform certain wireline operations (e.g., logging, perforating), production enhancement tools (e.g., downhole sensors), and the like. Each of the tools 20 may perform certain tasks related to collecting data or performing physical operations within the borehole.

At a surface, the drilling system 10 may include a platform and derrick assembly, which may be positioned over the borehole 16. Further, the downhole system may include a rotary table 22, a kelly 24, a hook 26, and/or a rotary swivel 28. The drill string 12 may be rotated via the rotary table 22 (e.g., energized by any suitable means), which may engage the kelly 24 at an upper end of the drill string 12. Further, the drill string 12 may be suspended by the hook 26, which may be attached to a traveling block via the kelly 24 and the rotary swivel 28. The kelly 24 and the rotary swivel may enable rotation of the drill string 12 relative to the hook 26.

The drilling system 10 may also include drilling fluid 30 (e.g., mud) stored in a pit 32 formed at a well site. A pump 34 may deliver the drilling fluid 30 to an interior of the drill string 12 via one or more ports of the rotary swivel 28. Thus, the drilling fluid may flow downwardly through the drill string 12 (e.g., as indicated by a directional arrow 36). The drilling fluid 30 may exit the drill string 12 via one or more ports of the drill bit assembly 14 and circulate upwardly through an annulus region between an outside of the drill string 12 and a wall of the borehole 16 (e.g., as indicated by directional arrows 38). The drilling fluid 30 may lubricate the drill bit assembly 14 and carry formation cuttings up to the surface as it is returned to the pit 32 for recirculation.

In some embodiments, the downhole assembly 18 may include a measuring while drilling (MWD) module, a logging-while-drilling (LWD) module, and/or a roto-steerable system and motor. The LWD module may be housed in a drill collar of the drill string 12 and include one or more logging tools, such as resistivity tools, density tools, acoustic tools, or any other suitable logging tool. Thus, the LWD module may measure, process, and/or store data obtained by the one or more logging tools and/or communicate (e.g., transmit) the data to any suitable surface equipment.

The MWD module may also be housed in the drill collar of the drill string 12 and include one or more devices for measuring characteristics (e.g., downhole parameters) of the drill string 12 and/or the drill bit assembly 14. In some embodiments, at least one of the downhole tools 20 may be the MWD module. Additionally, in some embodiments, the MWD module may include a device for generating electrical power for the drilling system 10. For example, the device for generating electrical power may be a mud turbine generator powered by the flow of the drilling fluid 30. It should be noted that any other suitable device for generating electrical power may be used for the drilling system 10. Moreover, the MWD module may include one or more measuring devices, such as a weight-on-bit measuring device, a shock measuring device, a stick slip measuring device, a direction measuring device, an inclination measuring device, and/or the like.

The drill bit assembly 14 may include a rotary steerable sub (RSS) (e.g., a PowerDrive system). The RSS sub may include a chassis (e.g., pressure housing, pressure barrel, cavity, casing), which may include one or more electrical components mounted to and/or included within the chassis. The electrical components may include Ethernet devices (e.g., Ethernet technology), a reservoir formation measurement component, electromagnetic (EM) transceiver equipment, one or more sensors, and the like. Additional details regarding the Ethernet devices will be described below with respect to FIGS. 2-4. The chassis may provide a stiffness to protect the electrical components from downhole environmental conditions, such as shock and/or vibration. Additionally or alternatively, the chassis may serve as a heat sink to draw heat from thermally active electronic components. The electrical components may be connected to one or another via interconnections (e.g., printed electrical connections) that may enable the electrical components to transfer electrical signals and/or electrical power between respective electrical components. It should be noted that any suitable number of electrical components may be employed by the chassis. The LWD module, the MWD module, and/or the electrical components may obtain data from and/or communicate data to a data acquisition system 40.

Figure 2:
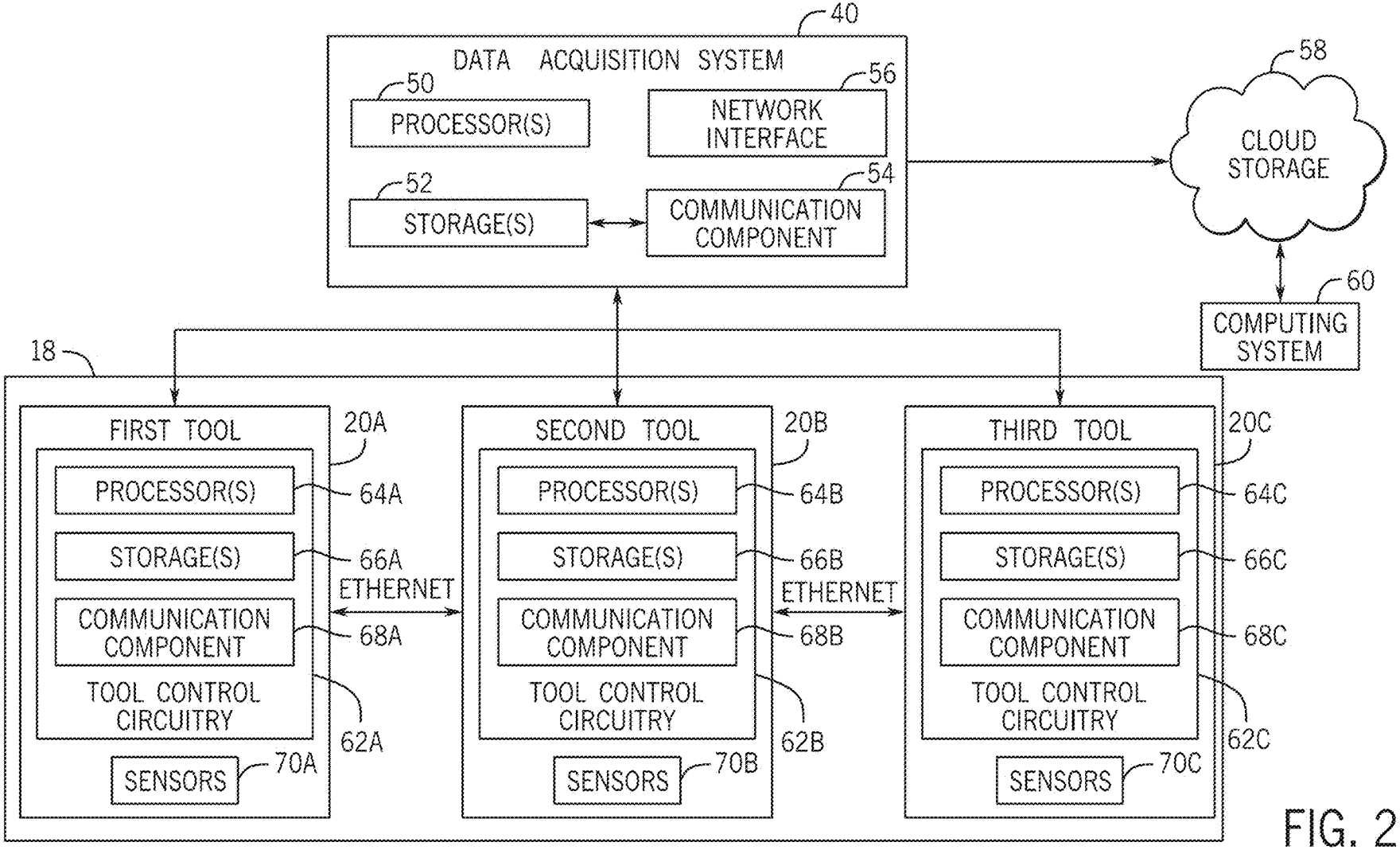
FIG. 2 is a block diagram of the drilling system of FIG. 1 including a data acquisition system, in accordance with an embodiment of the present disclosure.

FIG. 2 is a block diagram of the drilling system 10 of FIG. 1 including the data acquisition system 40, in accordance with an embodiment of the present disclosure. The data acquisition system 40 may include one or more processors 50 (referred to herein, in a singular form, as a "processor 50" for convenience), one or more storages 52 (referred to herein, in a singular form, as a "storage 52" for convenience), a communication component 54 (e.g., communication circuitry), and/or a network interface 56. The processor 50 may be any type of computer processor or microprocessor capable of executing computer-executable code, such as a microcontroller, a processor module or subsystem, a programmable integrated circuit, a programmable gate array, a digital signal processor (DSP). The processor 50 may also include multiple processors, processing circuitry, or a processing system that may perform the operations described herein.

The storage 52 (e.g., storage media, memory) may be implemented as one or more non-transitory computer-readable or machine-readable storage media. In certain embodiments, the storage 52 a volatile memory, such as random-access memory (RAM), and/or a nonvolatile memory (ROM). The storage may store a variety of information and may be used for various purposes. For example, the storage 52 may store processor-executable instructions, such as instructions for controlling the downhole tools 20 of the drill string 12 and/or any other suitable component associated with the drilling system 10. The storage 52 may also include flash memory, or any suitable optical, magnetic, or solid-state storage medium, or a combination thereof. The storage 52 may store data, instructions (e.g., software or firmware), and any other suitable information. In certain embodiments, the storage 52 may be located either in the machine running the machine-readable instructions, or may be located at a remote site from which machine-readable instructions may be downloaded over a network for execution.

The communication component 54 may include a wired or wireless communication component that facilitates communication between the downhole tools 20, the data acquisition system 40, cloud storage 58, an external computing system 60, and/or various other computing systems. It should be noted that, the communication component 54 may be a communication bus that enables communication access to multiple devices within the drilling system 10 after the drilling system 10 is extracted from the borehole. For example, the communication bus may be integrated with Ethernet technology to enable any suitable device within the drilling system 10 to communicate via an Ethernet communication port (e.g., using Ethernet devices) that connects to the downhole tools 20 after the downhole tools 20 are extracted from the borehole. In some embodiments, the communication component 54 may include a Power over Ethernet (POE) switch (e.g., a network switch) that may provide data connection and/or power supply to any suitable device with Ethernet connectivity. The POE switch may include one or more ports (e.g., Ethernet ports), where some ports may be capable of delivering power, while other ports may function for data transmission. Thus, the data acquisition system 40 may communicate with each of the tools 20 when the tools 20 are positioned at the surface (e.g., above ground rather than downhole) via the communication component 54 using Ethernet.

Additionally or alternatively, the communication component 54 may include antennas, transceiver circuits, signal processing hardware, software (e.g., hardware or software filters, A/D converters, multiplexers amplifiers), or a combination thereof, that may be configured to communicate over wired and/or wireless communication paths (e.g., a hardwired network, Infrared (IR) wireless communication, satellite communication, broadcast radio, Microwave radio, Bluetooth, Zigbee, Wi-fi, UHF, NFC). In some embodiments, the communication component 54 may include mud pulse telemetry to modulate a signal through pressure waves in a mud line. In other embodiments, the communication component 54 may transmit electromagnetic waves through a surface. In yet another embodiment, the communication component 54 may include wired drill pipes, which may include an embedded wire to provide an electrical connection across the drilling system 10.

In some embodiments, the data acquisition system 40 may include the network interface 56, which may enable the data acquisition system 40 to communicate with various downhole components and/or surface equipment of the drilling system 10 as discussed above. Additionally or alternatively, the network interface 56 may enable the data acquisition system 40 to communicate data to the cloud storage 58 (or other wired and/or wireless communication network) to, for example, store the data, archive the data, and/or enable the external computing system 60 to access the data and/or to remotely interact with the data acquisition system 40.

As described herein, the first tool 20A, the second tool 20B, and/or the third tool 20C of the drill string 12 may communicate with each other via tool control circuitry 62A, tool control circuitry 62B, and/or tool control circuitry 62C using Ethernet networking protocols while in the borehole. The first tool 20A may include tool control circuitry 62A that includes one or more processors 64A (referred to herein, in a singular form, as a "processor 64A" for convenience), one or more storages 66A (referred to herein, in a singular form, as a "storage 66A" for convenience), and/or a communication component 68A. The processor 64A may be similar to and/or the same as the processor 50. The storage 66A may be the same as and/or similar to the storage 52. The communication component 68A may be the same as or similar to the communication component 54. Indeed, the communication component 68A may employ Ethernet communication. In some embodiments, the tool control circuitry 62A may be included within the chassis, enabling the tool control circuitry 62A (e.g., the processor 64A, the storage 66A, and/or the communication component 68A) to be shielded from environmental conditions (e.g., environmental factors), such as temperature, pressure, vibration, shock, electricity, and the like. In this manner, the chassis may provide protection for the tool control circuitry 62A from the environmental conditions.

The first tool 20A may also include one or more sensors 70A (e.g., downhole sensors) communicatively coupled to the tool control circuitry 62A. The sensors 70A may include any suitable sensor capable of gathering data associated with subsurface conditions and/or well performance of the drilling system 10. Further, the sensors 70A may be designed to withstand any suitable environment, such as a high temperature environment, an extreme pressure environment, and the like. As an example, the sensors 70A may include pressure sensors, temperature sensors, flow sensors, acoustic sensors, density and composition sensors, strain and stress sensors, and the like. The sensors 70A may gather the data to enable operators to monitor and/or control downhole conditions in real-time, improve production processes, and/or make informed decisions to increase reservoir recovery. In some embodiments, the sensors 70A may be mounted on the chassis described herein with respect to FIG. 1. In other embodiments, the sensors 70A may be included within the first tool 20A. In this manner, the sensors 70A may be securely fastened and protected from vibration, temperature, and/or pressure from a harsh environment.

The sensors 70A may provide the data to the tool control circuitry 62A to store in the storage 66A. For example, the storage 66A may include a local memory to store the data gathered by the sensors 70A. Moreover, the data may be transmitted, via the communication component 68A, either to the second tool 20B, the third tool 20C, and/or the data acquisition system 40 (e.g., when the tools 20 are present at the surface) for storage elsewhere or for transmission to other devices. For example, the tool control circuitry 62A may be instructed (e.g., by the data acquisition system 40) to transmit the acquired data to the second tool 20B in response to detecting damage to the storage 66A (e.g., corrupted storage, within threshold of capacity). In some embodiments, the tool control circuitry 62A may transmit data acquired via the sensors 70A directly to the second tool 20B, and/or the third tool 20C via the Ethernet network. In some embodiments, if the storage 66A of the first tool 20A is full, the tool control circuitry 62A may transmit the data to the second tool 20B, and/or the third tool 20C in real time. It should be noted that the tool control circuitry 62B of the second tool 20B and the tool control circuitry 62C of the third tool 20C may operate similar to and/or the same as the tool control circuitry 62A of the first tool 20A.

In the same manner as described above, the second tool 20B and the third tool 20C may include the tool control circuitry 62B/62C that includes one or more processors 64B/64C (referred to herein, in a singular form, as a "processor 64B/64C" for convenience), one or more storages 66B/66C (referred to herein, in a singular form, as a "storage 66B/66C" for convenience), a communication component 68B/68C, and/or one or more sensors 70B/70C. The processor 64B and the processor 64C may be similar to and/or the same as the processor 64A. The storage 66B and the storage 66C may be the same as and/or similar to the storage 66A. The communication component 68B and the communication component 68C may be the same as or similar to the communication component 68A. Moreover, the sensors 70B and the sensors 70C may be similar to and/or the same as the sensors 70A.

Therefore, each of the respective tool control circuitry 62 (e.g., 62A, 62B, and/or 62C) may acquire (e.g., receive) the data associated with the subsurface conditions and/or the well performance from their respective sensors 70 (e.g., 70A, 70B, and/or 70C). Further, each of the respective tool control circuitry 62 may communicate the data either to a separate tool control circuitry 62 (e.g., other tool control circuitry 62) (e.g., and/or the data acquisition system 40 when extracted). Each of the respective tool control circuitry 62 may be connected via Ethernet network (e.g., wired or wirelessly) to each other while positioned. In this manner, the data acquisition system 40 may acquire data from each of the respective tool control circuitry 62 either simultaneously or at separate times.

As described above, the respective tool control circuitry 62 may communicate with other tool control circuitry 62. Thus, the respective tool control circuitry 62 may share (e.g., receive and/or transmit) data with other tool control circuitry 62. As such, each of the respective tool control circuitry 62 may collectively enable a redundant storage for each of the tools 20. Thus, for example, if storage of data on the first tool 20A via the storage component 66A were to fail, the data may be stored on and/or retrieved from the storage component 66B of the second tool 20B. As another example, if data stored on the second tool 20B via the storage 66B were lost, then the data may be retrieved from the storage component 66C of the third tool 20C. Therefore, the redundant storage between the tools 20 may enable an improvement in data maintenance. Indeed, the redundant storage may reduce or minimize data loss, improve data integrity, and/or improve data availability.

Additionally or alternatively, each of the respective tool control circuitry 62 may be communicatively coupled via a switch (e.g., external switch, a central hub, a POE switch, an Ethernet switch). Therefore, as data is transmitted from each of the respective tool control circuitry 62 to the switch, at least one or all of the tools 20 may receive a copy of the data (e.g., via the respective tool control circuitry 62). In this manner, each of the respective tool control circuitry 62 may analyze and/or store the data in parallel, which may reduce or minimize operational time (e.g., rig time), improve answer product delivery, and/or enable systematic capture of the data for each job performed by the drilling system 10. In some embodiments, the tool control circuitry 62 may employ machine learning to determine efficient storage locations (e.g., between the first tool 20A, the second tool 20B, and/or the third tool 20C) for data acquired by each of the tools 20, perform analytics for improved tool operation based on the acquired data, or the like. That is, since the tools 20 may be interconnected with communication components that enable the sharing of data via Ethernet networking, improved tool operations may be determined by the tool control circuitries 62.

Figure 3:
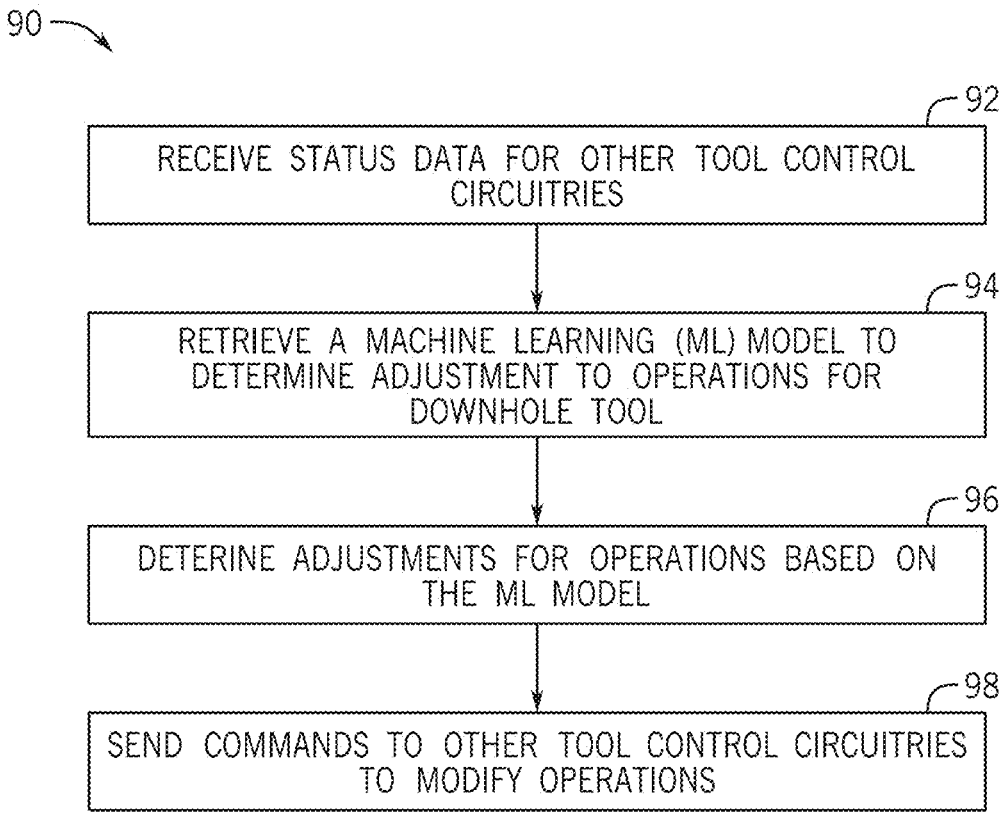
FIG. 3 is a flowchart of a method for adjusting operations of a downhole tool of the drilling system, in accordance with an embodiment of the present disclosure.

FIG. 3 is a flowchart of a method 90 for adjusting operations of the tools 20 of the drilling system 10, in accordance with an embodiment of the present disclosure. Although the following description of FIG. 3 is discussed as being performed by the tool control circuitry 62, it should be understood that any suitable component may perform the method 90 in any suitable order. For example, the method 90 may be performed by the data acquisition system 40. As another example, the method 90 may be performed by the external computing system 60.

Referring now to FIG. 3, at process block 92, the tool control circuitry 62 may receive data (e.g., datasets) from other tool control circuitries 62. For example, the tool control circuitry 62A of the first tool 20A may receive data of the tool control circuitry 62B of the second tool 20B and/or the tool control circuitry 62C of the third tool 20C. As described herein, the tool control circuitry 62 may receive the data from other tool control circuitries 62 via Ethernet networking. For example, the data may be received while the tool control circuitry 62 is performing operations downhole. The data may include a unique identifier for the particular tool 20, operating parameters of the tool 20 (e.g., pressure, temperature, flow rate, and the like), tool health (e.g., status of components of the tool 20), drilling parameters (e.g., drilling dysfunction, weight on bit, mud properties, drill string rotation, and the like), communication status (e.g., connectivity with the data acquisition system 40 or any other suitable surface system), network status (e.g., connectivity with the Ethernet network and/or Ethernet technology, network latency, bandwidth availability), performance metrics of the tool 20, and the like.

At process block 94, the tool control circuitry 62 may retrieve a machine learning (ML) model associated with the specific set of tools 20 that are employed in the drill string 12. The ML models may be stored in a database, the cloud storage 58, within the storage 66 of a respective tool 20, or the like. The ML model may provide recommended operations, interpretations of measurements collected by the tools 20, assessments of a type of formation the tools 20 are traversing, feature inference associated with the tools 20, drilling dysfunctions of the tools 20 (e.g., stick-slip, whirl, bit bounce, and the like), adjustments to operations of the tools 20, and the like. A number of ML models may be generated over time based on data related to different tools 20 deployed across the world. After applying the ML model, the tool control circuitry 62 may store an output (e.g., model output, trained data) of the ML model to enable retrieval of the data output rather than raw measurements. It should be noted that any other suitable analytic tool may be employed by the tool control circuitry 62.

At process block 96, the tool control circuitry 62 may determine one or more adjustments for operations based on the ML model. Indeed, the tool control circuitry 62 may use the output of the ML model to determine the adjustments to drilling operations and/or logging operations at least one of the tools 20 to update one or more operations of the tools 20. For example, the adjustments may include adjustments to the drilling parameters, such as adjustment to rotational speed, weight on bit, flow rate, mud properties, and the like. Indeed, the adjustment may include an adjustment of a rate or force applied by the tool 20. As another example, the tool control circuitry 62 may determine adjustments to a firing or acquisition sequence of a subsystem (e.g., a component) of the tools 20, such as initiation and/or control of the subsystem of the tools 20. Thus, as the data is received, the tool control circuitry 62 may use the ML model to analyze (e.g., process) the data to adjust operations of at least one of the tools 20 of the drilling system 10 to reduce drilling dysfunction and/or enable collection of accurate measurements.

In some embodiments, the tool control circuitry 62 may share data with each other via the Ethernet to coordinate operations of and/or determine adjustments to the respective tool 20. That is, if the first tool 20A is performing measurement operations that includes collecting data that may be useful for coordination operations of the second tool 20B, the tool control circuitry 62B may request the relevant data from the tool control circuitry 62A to cause the tool control circuitry 62A to route the data to the tool control circuitry 62B. The tool control circuitry 62B may then use the received data to control the respective operations of the second tool 20B.

At process block 98, the tool control circuitry 62 may send commands to other tool control circuitries 62 to modify operations of the other tools 20 based on the analysis performed at block 96. As described herein, the commands may be communicated via the Ethernet communication employed by the tool control circuitry 62 via communication ports that communicatively couple the tools 20 to each other. For example, the tool control circuitry 62 may apply the ML model to analyze the data to determine that the tools 20 are traversing reservoir boundaries. Thus, the tool control circuitry 62 may send steering commands to other tool control circuitries 62 to cause the RSS to remain within the reservoir boundaries. As another example, the tool control circuitry 62 may apply the ML model to analyze the data to determine the tools 20 are experiencing high formation pressure while drilling. Therefore, the tool control circuitry 62 may send a command to other control circuitries 62 to adjust a mud weight to balance pressure and reduce wellbore instability. It should be noted that the tool control circuitry 62 may transmit the commands at any suitable time, such as while the tools 20 are in operation and/or after completion of operations.

As described herein, the Ethernet communication protocol employed within each tool 20 may include Power over Ethernet (POE). As such, electrical voltage or power may be transmitted along with data via the wires or electrical connections providing Ethernet data. In some embodiments, a POE switch may regulate power and data connectivity between each of the tool control circuitries 62 over an Ethernet cable. Therefore, the POE switch may establish the Ethernet communication between each of the tool control circuitries 62 and/or the data acquisition system 40. Additional details regarding the POE switch and the connectivity of the POE switch to the tool control circuitries 62 will be described below with respect to FIG. 4

Figure 4:
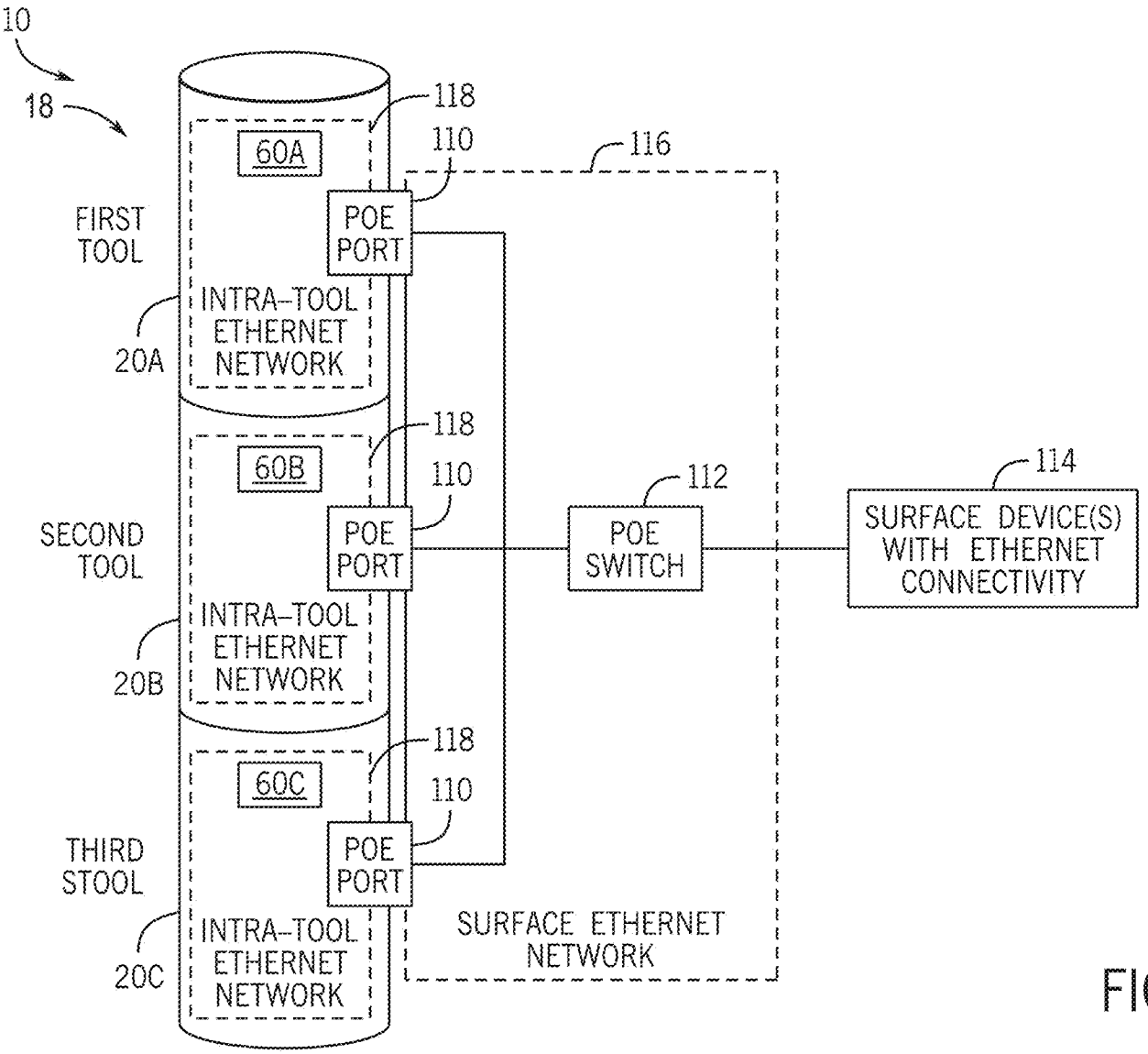
FIG. 4 is an illustration of a downhole assembly of the drilling system of FIG. 1 when the downhole assembly is positioned at a surface, in accordance with an embodiment of the present disclosure.

FIG. 4 is an illustration of the downhole assembly 18 of the drilling system 10 of FIG. 1 when the downhole assembly 18 is positioned at the surface, in accordance with an embodiment of the present disclosure. As described herein, the drill string 12 may include the first tool 20A, the second tool 20B, and/or the third tool 20C. Further, the first tool 20A may include the tool control circuitry 62A, the second tool 20B may include the tool control circuitry 62B, and the third tool 20C may include the tool control circuitry 62C. In addition, the first tool 20A may include a PoE port 110A, the second tool 20B may include a PoE port 110B, and/or the third tool 20C may include a PoE port 110C. The PoE ports 110 may enable data and electrical power be transmitted over one or more Ethernet cables. In some embodiments, an Ethernet cable may be used to couple different tools 20 to each other via the PoE ports 110.

In addition, the drilling system 10 may include a POE switch 112 communicatively coupled to each of the tools 20 via the PoE ports 110. The POE switch may also be communicatively coupled to one or more surface devices 114 (e.g., the data acquisition system 40). The POE switch 112 may provide power to any suitable PoE compatible device, such as the tools 20. As such, a process of installation and/or use may be simplified by eliminating use of additional power cables to provide power to each of the tools 20. In some embodiments, each of the PoE ports 110 may be communicatively coupled to the respective tool control circuitries 62 (and/or the respective processors 64 of the tool control circuitries 62) to enable the Ethernet communication.

Moreover, as illustrated in FIG. 4, each of the tool control circuitries 62 may be mounted on or included within the respective tools 20. As described herein, each of the tools 20 may include the chassis or chamber, which may house or support the tool control circuitries 62. Each respective chassis may provide protection from volatile downhole elements (e.g., pressure, temperature) for each respective tool control circuitry 62. That is, the chassis may provide shielding from environmental conditions that each respective tool control circuitry 62 may be exposed to when operating downhole. For example, the chassis may include a frame or a housing that may securely hold the respective tool control circuitry 62 in place, preventing the respective tool control circuitry 62 from shifting and/or damage during operation and/or transportation. Additionally or alternatively, the chassis may include mounting points or slots (e.g., connectors, switches, and the like) that may accommodate the respective tool control circuitry 62. In this way, data communicated between the tools 20 may maintain its integrity and avoid data losses or corruption due to noise related to the operational conditions within the borehole.

Each of the tools 20, the POE switch 112, and/or the surface devices 114, such as the data acquisition system 40, may be connected to a surface Ethernet network 116 via Ethernet cables. The POE switch 112 may operate as an Ethernet switch by facilitating Ethernet communication between the tools 20 and the surfaces devices 114 within the surface Ethernet network 116. For example, the POE switch 112 may enable transmission of data packets encapsulated in Ethernet frames. The Ethernet frames may contain various fields, such as a source Media Access Control (MAC) address, a destination MAC address, a frame check sequence (FCS), and the like.

The POE switch 112 may enable extraction of data from each of the tools 20 in parallel by receiving and processing data packets received from each of the tools 20 simultaneously. Indeed, the POE switch 112 may enable receipt and/or transmission of data from the tools 20 concurrently via the surface Ethernet network 116. The POE switch 112 may also enable parallel processing of multiple data streams from the tools 20 concurrently. Thus, the POE switch may improve efficiency in operations by enabling parallel processing to improve efficiency in data extraction from the tools 20 using the Ethernet communication. The POE switch 112 may also route and/or forward the multiple data streams to any suitable surface device 114.

Additionally, the POE switch 112 may deliver power over the same Ethernet cables. For example, the power delivery may adhere to the Institute of Electrical and Electronics Engineers (IEEE) 802.3af or 802.3at standards and may include eight wires. As the tools 20 are connected to the POE switch 112 via the PoE ports 110, the POE switch 112 may detect each of the tools 20, determine whether to deliver power to each of the tools 20, and/or deliver (e.g., allocate) an appropriate amount of power to each of the tools 20. It should be noted that while the POE switch 112 is described as being employed by the drilling system 10, any other suitable switch may be employed in the drilling system 10. For example, the Ethernet switch (e.g., without power delivery) may be employed by the drilling system 10.

As illustrated, the first tool 20A, the second tool 20B, and the third tool 20C may be communicatively coupled to an intra-tool Ethernet network 118. The intra-tool Ethernet network 118 may enable each of the tools 20 within the drill string 12 to communicate directly with one another (e.g., without relying on an external network). The intra-tool Ethernet network 118 may facilitate efficient data communication between the tools 20, which may improve performance and/or reliability of the drilling system 10. Indeed, the intra-tool Ethernet network 118 may improve efficiency by enabling the tool control circuitries 62 to access available bandwidth of the intra-tool Ethernet network 118. That is, the tools 20 may communicate with one another without impact of congestion and/or additional traffic from external devices or networks.

Therefore, the embodiments described herein enable an increase in the amount of data stored by the drilling system 10 by enabling communication and networking between the tools 20 while the tools 20 are positioned downhole within the borehole. Indeed, the drilling system 10 may employ the Ethernet technology (e.g., the tool control circuitries 62, the PoE ports 110, the POE switch 112) to communicate using Ethernet networking and improve efficiency in communication of the data between the tools 20 via the Ethernet communication. Moreover, accessibility and/or efficiency in the retrieval of the data by the data acquisition system 40 or any other suitable surface device 114 may be improved by employing the Ethernet technology to retrieve the data simultaneously or at separate times. Additionally, communication of the data between each of the tools 20 may enable a redundant storage for each of the tools 20, which may improve data maintenance, reduce or minimize data loss, and/or improve data integrity of the drilling system 10. Further, each respective tool 20 may house each respective tool control circuitry 62 and provide protection to the respective tool control circuitry 62 from environmental conditions enabling the tool control circuitry 62 to operate in harsh conditions (e.g., high temperature, large amount of vibration, electricity, and the like). As such, the embodiments described herein may improve networking technology in downhole tools by facilitating management and consumption of data through the use of networking technology (e.g., the Ethernet technology) between each of the tools 20 while the tools 20 are positioned downhole.

The technical effect of the disclosed embodiments include the one or more downhole tools 20 that employ the Ethernet technology (e.g., component) to improve efficiency in communication of the data between the tools 20 while the tools 20 are positioned downhole. The integration of the Ethernet technology in the tools 20 may enable redundancy for storage via any suitable tool 20. Further, the Ethernet technology may enable efficient data retrieval from each of the tools 20 simultaneously or at separate times. Additionally or alternatively, the tools 20 may be communicatively coupled to the switch 112, which may enable at least one of the tools 20 to receive a copy of data passing through the switch 112, analysis, and/or storage in parallel to improve network monitoring capabilities. Each respective tool 20 may house any suitable Ethernet technology to provide protection from volatile downhole elements. Accordingly, the technical effect of the disclosed embodiments includes an improvement in facilitation, management, and/or consumption of data through the use of the Ethernet technology in the drilling system 10.

The subject matter described in detail above may be defined by one or more clauses, as set forth below.

A system includes a first tool comprising first control circuitry, wherein the first tool is configured to perform a first operation within a borehole, and a second tool including second control circuitry, wherein the second tool is configured to perform a second operation within the borehole, and wherein the first control circuitry is configured to communicate with the second control circuitry via Ethernet.

The system of the preceding clause, including a data acquisition system configured to communicatively couple to the first control circuitry and the second control circuitry, and an Ethernet switch configured to communicatively couple to the data acquisition system, the first control circuitry, and the second control circuitry via Ethernet.

The system of any preceding clause, wherein the first control circuitry includes a processing system and a storage, the storage encoded with instructions configured to be executed by the processing system to cause the first control circuitry to identify a set of data for transmission to the second control circuitry, and transmit the set of data to the second control circuitry via Ethernet.

The system of any preceding clause, wherein the first control circuitry is communicatively coupled to one or more sensors configured to collect the set of data.

The system of any preceding clause, wherein the set of data includes subsurface data, data associated with the first tool, data associated with the second tool, or any combination thereof.

The system of any preceding clause, wherein the first control circuitry, the second control circuitry, or both are configured to communicatively couple to a surface Ethernet network via a communication port.

The system of any preceding clause, wherein the first control circuitry and the second control circuitry are configured to receive Power over Ethernet (POE).

The system of any preceding clause, wherein the first control circuitry includes a first PoE port to communicatively couple to the second control circuitry via a second PoE port.

The system of any preceding clause, wherein the first control circuitry is configured to apply a machine learning (ML) model to determine one or more operational changes for the second tool.

A tangible, non-transitory, computer-readable medium including instructions that, when executed by processing circuitry, are configured to cause the processing circuitry to instruct a first tool to perform a first operation within a borehole, retrieve a set of data for transmission to additional processing circuitry of a second tool configured to perform a second operation within the borehole, wherein the set of data for transmission is identified based on the first operation, and transmit the set of data to the additional processing circuitry via Ethernet.

The tangible, non-transitory, computer-readable medium of the preceding clause, wherein the instructions are configured to cause the processing circuitry to receive the set of data via one or more sensors communicatively coupled to the processing circuitry.

The tangible, non-transitory, computer-readable medium of any preceding clause, wherein the instructions are configured to cause the processing circuitry to receive an additional set of data from the additional processing circuitry, apply one or more machine learning (ML) models to determine one or more updated operations for the first tool based on the additional set of data, and modify one or more operations of the first tool based on the one or more updated operations.

The tangible, non-transitory, computer-readable medium of any preceding clause, wherein the instructions are configured to cause the processing circuitry to communicatively couple to a surface Ethernet network via a communication port.

The tangible, non-transitory, computer-readable medium of any preceding clause, wherein the instructions are configured to cause the processing circuitry to communicatively couple to the additional processing circuitry via an Ethernet switch.

The tangible, non-transitory, computer-readable medium of any preceding clause, wherein the instructions are configured to cause the processing circuitry to receive Power over Ethernet (POE).

A method includes instructing, via first control circuitry, a first tool of a drilling system to perform a first operation within a borehole, retrieving, via the first control circuitry, a set of data for transmission to second control circuitry of the drilling system, a data acquisition system, or both, based on the first operation, and transmitting, via the first control circuitry, the set of data to the second control circuitry via Ethernet.

The method of the preceding clause, wherein the set of data is transmitted to the second control circuitry via Ethernet while the first operation is being performed.

The method of any preceding clause, wherein the set of data includes subsurface data, data associated with the first tool, or both.

The method of any preceding clause, including applying, via the first control circuitry, a machine learning (ML) model to determine one or more operational changes for the second control circuitry.

The method of any preceding clause, including receiving, via the first control circuitry, the set of data via one or more sensors communicatively coupled to the first control circuitry.

The foregoing description, for purpose of explanation, has been described with reference to specific embodiments. However, the illustrative discussions above are not intended to be exhaustive or to limit the disclosure to the precise forms disclosed. Many modifications and variations are possible in view of the above teachings. Moreover, the order in which the elements of the methods described herein are illustrated and described may be re-arranged, and/or two or more elements may occur simultaneously. The embodiments were chosen and described in order to best explain the principals of the disclosure and its practical applications, to thereby enable others skilled in the art to best utilize the disclosure and various embodiments with various modifications as are suited to the particular use contemplated.

Finally, the techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a first tool comprising first control circuitry integrated within the first tool, wherein the first tool is configured to perform a first operation within a borehole; and a second tool comprising second control circuitry integrated within the second tool, wherein the second tool is configured to perform a second operation within the borehole, and wherein the first control circuitry is configured to communicate with the second control circuitry via Ethernet.

2. The system of claim 1, comprising:

a data acquisition system configured to communicatively couple to the first control circuitry and the second control circuitry; and an Ethernet switch configured to communicatively couple to the data acquisition system, the first control circuitry, and the second control circuitry via Ethernet.

3. The system of claim 1, wherein the first control circuitry, the second control circuitry, or both are configured to communicatively couple to a surface Ethernet network via a communication port.

4. The system of claim 1, wherein the first control circuitry and the second control circuitry are configured to receive Power over Ethernet (POE).

5. The system of claim 4, wherein the first control circuitry comprises a first PoE port communicatively coupled to the second control circuitry via a second PoE port.

6. The system of claim 1, wherein the first control circuitry is configured to apply a machine learning (ML) model to determine one or more operational changes for the second tool.

7. The system of claim 1, wherein the first control circuitry and the second control circuitry are communicatively coupled to an intra-tool Ethernet network, and wherein the first control circuitry is configured to communicate with the second control circuitry via the intra-tool Ethernet network.

8. The system of claim 7, wherein the first control circuitry is configured to communicate with the second control circuitry via the intra-tool Ethernet network while the first tool and the second tool are positioned within the borehole.

9. The system of claim 8, wherein:

the first tool comprises one or more first sensors configured to collect first data associated with the first tool performing the first operation within the borehole, and wherein the first control circuitry is configured to transmit the first data associated with the first tool performing the first operation within the borehole to the second control circuitry via the intra-tool Ethernet network while the first tool is performing the first operation; and the second tool comprises one or more second sensors configured to collect second data associated with the second tool performing the second operation within the borehole, and wherein the second control circuitry is configured to transmit the second data associated with the second tool performing the second operation within the borehole to the first control circuitry via the intra-tool Ethernet network while the second tool is performing the second operation.

10. A tangible, non-transitory, computer-readable medium comprising instructions that, when executed by processing circuitry, are configured to cause the processing circuitry to:

instruct a first tool comprising the processing circuitry integrated within the first tool to perform a first operation within a borehole;

retrieve a set of data for transmission to additional processing circuitry integrated within a second tool, the second tool configured to perform a second operation within the borehole, wherein the set of data for transmission is identified based on the first operation; and transmit the set of data to the additional processing circuitry via Ethernet.

11. The tangible, non-transitory, computer-readable medium of claim 10, wherein the instructions are configured to cause the processing circuitry to receive the set of data via one or more sensors communicatively coupled to the processing circuitry.

12. The tangible, non-transitory, computer-readable medium of claim 10, wherein the instructions are configured to cause the processing circuitry to:

receive an additional set of data from the additional processing circuitry;

apply one or more machine learning (ML) models to the additional set of data to determine one or more updated operations for the first tool; and modify one or more operations of the first tool based on the one or more updated operations.

13. The tangible, non-transitory, computer-readable medium of claim 10, wherein the instructions are configured to cause the processing circuitry to communicatively couple to a surface Ethernet network via a communication port.

14. The tangible, non-transitory, computer-readable medium of claim 10, wherein the instructions are configured to cause the processing circuitry to communicatively couple to the additional processing circuitry via an Ethernet switch.

15. The tangible, non-transitory, computer-readable medium of claim 10, wherein the instructions are configured to cause the processing circuitry to receive Power over Ethernet (POE).

16. A method comprising:

instructing, via first control circuitry integrated within a first tool, the first tool of a drilling system to perform a first operation within a borehole;

retrieving, via the first control circuitry, a set of data for transmission to second control circuitry integrated within a second tool of the drilling system based on the first operation; and transmitting, via the first control circuitry, the set of data to the second control circuitry via Ethernet.

17. The method of claim 16, wherein the set of data is transmitted to the second control circuitry via Ethernet while the first operation is being performed.

18. The method of claim 16, wherein the set of data comprises subsurface data, data associated with the first tool, or both.

19. The method of claim 16, comprising applying, via the first control circuitry, a machine learning (ML) model to determine one or more operational changes for the second control circuitry.

20. The method of claim 16, comprising receiving, via the first control circuitry, the set of data via one or more sensors communicatively coupled to the first control circuitry.

* * * * *